United States Patent [19]

Kishi

[11] Patent Number: 4,694,930

[45] Date of Patent: Sep. 22, 1987

[54] LIFTING APPARATUS

[75] Inventor: Mitsuihiro Kishi, Ashikaga, Japan

[73] Assignee: Kabushiki Kaisha Hikoma Seisakusho, Tochigi, Japan

[21] Appl. No.: 846,813

[22] Filed: Apr. 1, 1986

[30] Foreign Application Priority Data

| | | | |
|---|---|---|---|
| Apr. 3, 1985 | [JP] | Japan | 60-70459 |
| Apr. 13, 1985 | [JP] | Japan | 60-79041 |
| Jun. 11, 1985 | [JP] | Japan | 60-126830 |
| Jun. 17, 1985 | [JP] | Japan | 60-132593 |

[51] Int. Cl.[4] ..... B66F 11/04

[52] U.S. Cl. ..... 182/2; 182/63

[58] Field of Search ..... 182/2, 63; 52/121, 118

[56] References Cited

U.S. PATENT DOCUMENTS

| | | | |
|---|---|---|---|
| 3,776,367 | 12/1973 | Grove | 182/2 |
| 3,809,180 | 5/1974 | Grove | 182/2 |
| 3,856,108 | 12/1974 | Grove | 182/2 |
| 3,893,540 | 7/1975 | Beucher | 182/2 |
| 4,019,604 | 4/1977 | Benson | 182/2 |

*Primary Examiner*—Reinaldo P. Machado

*Attorney, Agent, or Firm*—Wenderoth, Lind & Ponack

[57] ABSTRACT

A lifting apparatus comprising a chassis, a platform, a stretchable boom assembly comprising lower, middle, upper and cover member respectively axially aligned with each other, a sliding member mounted on the upper boom including a hydraulic cylinder, and other three hydraulic cylinders respectively mounted in the lower boom, between the lower boom and the chassis and between the upper boom and the platform, a hydraulic control system for operating the three hydraulic cylinders in synchronism to move the platform toward and away from the chassis in a substantially perpendicular relation to the chassis. Load on the platform is imposed on the cover member, next on the stretchable member so that the load on the platform is stably movable horizontally and vertically irrespective of the level difference provided between each of the stretchable boom assembly.

11 Claims, 31 Drawing Figures

LIFTING APPARATUS

BACKGROUND OF THE INVENTION

1. Field of the Invention:

The present invention relates to a lifting apparatus capable of conveying persons and/or goods from or to different levels by raising a platform from a vehicle and, more particularly, to a lifting apparatus capable of moving horizontally and raising a platform vertically.

2. Description of the Prior Art:

Lifting apparatus capable of conveying persons and goods from or to different levels by raising or lowering a platform are used widely for assembling work, painting work or repairing work performed at high elevations on expressways and building construction sites. The typical conventional lifting apparatus employs a telescopic parallel mechanism, namely, a so-called scissors type linkage, comprising a plurality of pairs of arms with each pair of arms being pivotally joined at the middle. In order to increase the maximum lift of such a lifting apparatus, it is necessary to increase the length of the arms or to increase the number of the pairs of arms. Accordingly, such a lifting apparatus having a large lift needs a parallel mechanism consisting of many links. Therefore, the lifting platform of the lifting apparatus is located at a high level even when the parallel mechanism is collapsed, and hence it is difficult for persons to get on and off the platform and it is troublesome to load and unload the platform.

Lifting apparatus having a single extendable arm comprising a plurality of telescopically combined booms have been proposed in Japanese Patent Application Nos. 56-134487 and 56-191065.

All of the above-mentioned newly proposed lifting apparatus, however, inevitably need an increased number of booms, and hence so many components are necessary that troublesome manufacturing and assembling work is required and the lifting apparatus are expensive. Furthermore, the above-mentioned lifting apparatus have a large number of sliding parts for assembling the booms and arms. Since these sliding parts are provided with sliding members, such as MC nylon members, a large number of parts need to be replaced periodically requiring high inspection and maintenance costs and troublesome work.

Another lifting apparatus has been disclosed in Japanese Patent Application No. 59-95797. This lifting apparatus has a single extendable boom mounted on a vehicle, and the boom is telescopically moved in the manner of an expanding Z-shape as viewed from the side portion thereof. However, in this lifting apparatus it is difficult to support the platform horizontally when in a fixed elevated position since the single extendable boom is made up of a plurality of booms each of which is moved slidably in a telescopic manner and the surfaces of the booms are not even along the longitudinal axes thereof because of differences in cross section thereof. The differences in cross section between each boom thereby causes the expandable boom assembly to be unstable. Hence, it is difficult to mount a horizontal leveling mechanism on a telescopic boom to maintain the platform horizontal with respect to the chassis.

SUMMARY OF THE INVENTION

It is an object of the present invention to provide a lifting apparatus which is simple in construction and which can easily be manufactured.

Another object of the present invention is to provide a lifting apparatus which is stably maintained horizontally by means of a horizontal leveling mechanism and a level difference correction mechanism.

According to the present invention, there is provided a lifting apparatus including a base such as a mobile chassis, a platform, a telescopic boom assembly composed of lower, middle and upper booms respectively which are axially aligned with each other, at least one first hydraulic cylinder disposed in the telescopic boom assembly for extending and contracting the telescopic boom assembly, at least one second hydraulic cylinder operatively coupled between the telescopic boom assembly and the chassis for tilting the telescopic boom assembly with respect to the chassis, at least one third hydraulic cylinder operatively coupled between the telescopic boom assembly and the platform for keeping the platform substantially parallel to the chassis, and a hydraulic control system for operating the first, second, and third hydraulic cylinders in synchronism to move the platform toward and away from the base in a direction substantially perpendicular to the base. A spacer or roller is provided between an upper boom and a middle boom of the telescopic boom assembly as a horizontal leveling mechanism in cooperation with the first, second and third hydraulic cylinders.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
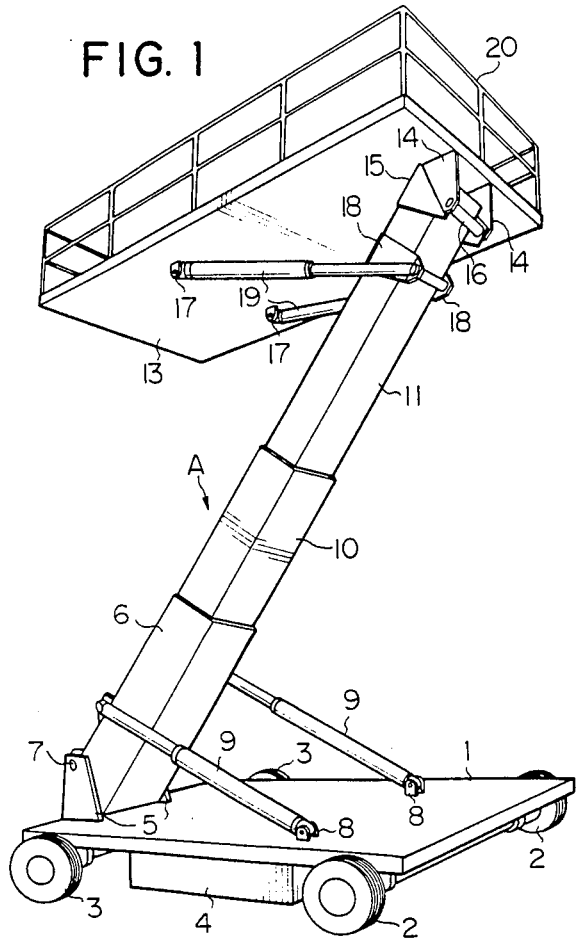
FIG. 1 is a perspective view of a lifting apparatus according to a first embodiment of the present invention.

The present invention will be described hereinafter with reference to preferred embodiments thereof in conjunction with the accompanying drawings in which identical or corresponding components are designated by identical or corresponding reference characters throughout the views.

Figure 2:
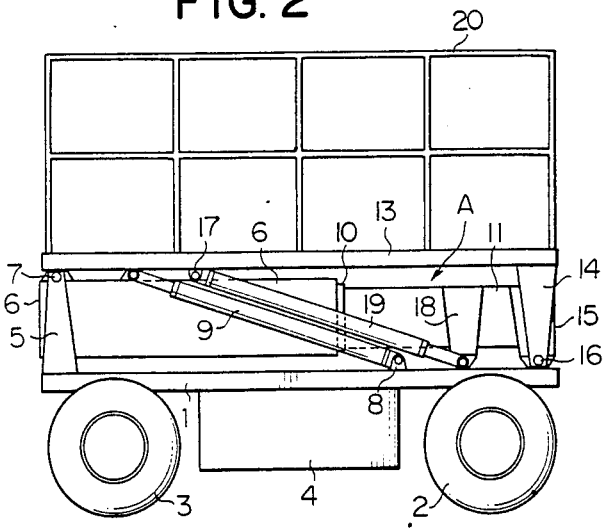
FIG. 2 is a side elevational view of the lifting apparatus of FIG. 1 as it is collapsed.

FIGS. 1 through 5 show a lifting apparatus according to a first embodiment of the present invention. As shown in FIGS. 1 through 5, the lifting apparatus comprises a mobile chassis or base 1 on which front and rear wheels 2, 3 are rotatably supported, a power box or engine compartment 4 attached to the lower surface of the chassis 1 and accommodating therein an engine, a hydraulic pump and other parts. A pair of spaced apart pedestals 5 are fixed to one longitudinal end of the topside of the chassis 1. A hollow lower boom 6 having a rectangular cross section is joined pivotally to the pedestals 5 by means of a pin 7. A pair of clevises 8 are fixed to the other longitudinal end of the topside of the chassis 1. A pair of hydraulic cylinders 9 for controlling the inclination of a telescopic boom assembly A are joined pivotally at the respective opposite ends thereof to fthe clevises 8 and the lower boom 6, respectively. A hollow middle boom 10 having a rectangular cross section is slidably fitted in the hollow lower boom 6, while a hollow upper boom 11 having a rectangular cross section is slidably fitted in the middle boom 10. The telescopic boom assembly A comprises the lower boom 6, the middle boom 10 and the upper boom 11. When the telescopic boom assembly A is fully contracted, the length from the lower end of the lower boom 6 to the tip end of the upper boom 11 is the same length as the chassis 1. The lower boom 6 and the middle boom 10 each have a length of about two-thirds the length of the chassis. When the telescopic boom assembly A is fully contracted (as shown in FIG. 2), the upper boom is exposed at the upper portion thereof by a length equal to about one third of the length of the telescopic boom assembly A, namely the upper portion of the upper boom 11 is not accomodated in the lower boom 6 when the telescopic boom is fully contracted. Designated at 13 is a flat platform having a floor which is substantially the same in area as the chassis 1. Pedestals 14 are fixed to the underside of the platform on opposite sides of the end of the telescopic boom assembly A.

The upper boom 11 is pivotally inserted between the pedestals 14. The pedestals 14 and attachments 15 fixedly mounted at opposite sides of the tip end of the upper boom 11 are pivotally connected by means of a pin 16. A pair of clevises 17 are fixed to the underside of the platform at an end thereof opposite to the pedestals 14. Pedestals 18 are fixed on opposite sides of the upper boom at a location spaced from the tip end of the upper boom 18. Hydraulic cylinders 19 are pivotally connected between the clevises 17 and the pedestals 18. A handrail 20 is provided around the periphery of the upper surface of the platform.

Figure 5:
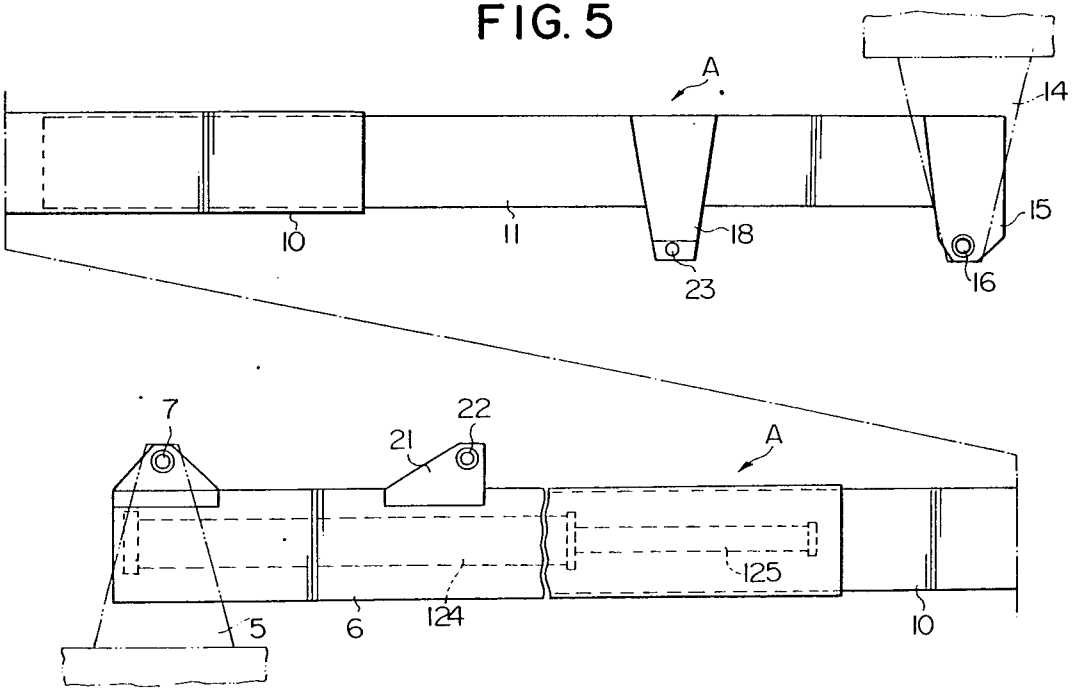
FIG. 5 is a fragmentary side elevational view of a telescopic assembly of the lifting apparatus shown in FIG. 4.
Figure 6:
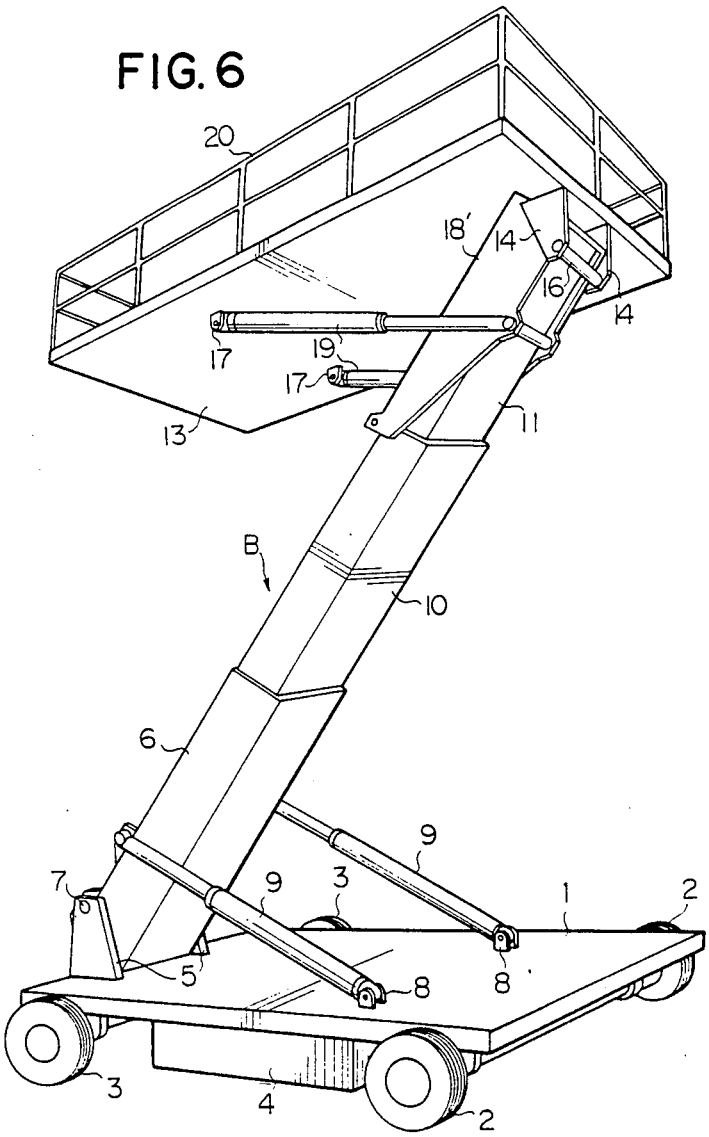
FIG. 6 is a perspective view of a lifting apparatus according to a second embodiment of the present invention.

FIG. 5 shows an internal structure of the telescopic boom assembly A which is composed of the lower boom 6, the middle boom 10 and the upper boom 11. Pedestals 21 are fixed to opposite sides on the upper portion of the lower end of the lower boom 6 at a position spaced about one third from the left or lower end of the lower boom 6 as shown in FIG. 5. The pedestals 21 have holes 22 for connecting the hydraulic cylinders 9 thereto and the pedestals 18 also have holes 23 for connecting the hydraulic cylinders 19 thereto. A hydraulic cylinder 124 is fixedly inserted in the center of the inside of the lower boom 6 and a cylinder rod 125 of the hydraulic cylinder 124 is directed toward and attached to the upper boom 11. The middle boom 10 and the upper boom 11 may be expanded and contracted synchronously by the cylinder rod 125 which is actuated by conventional means.

Figure 3:
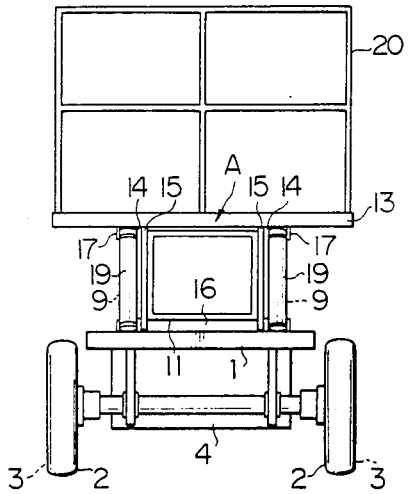
FIG. 3 is a front elevational view of the lifting apparatus shown in FIG. 2.
Figure 4:
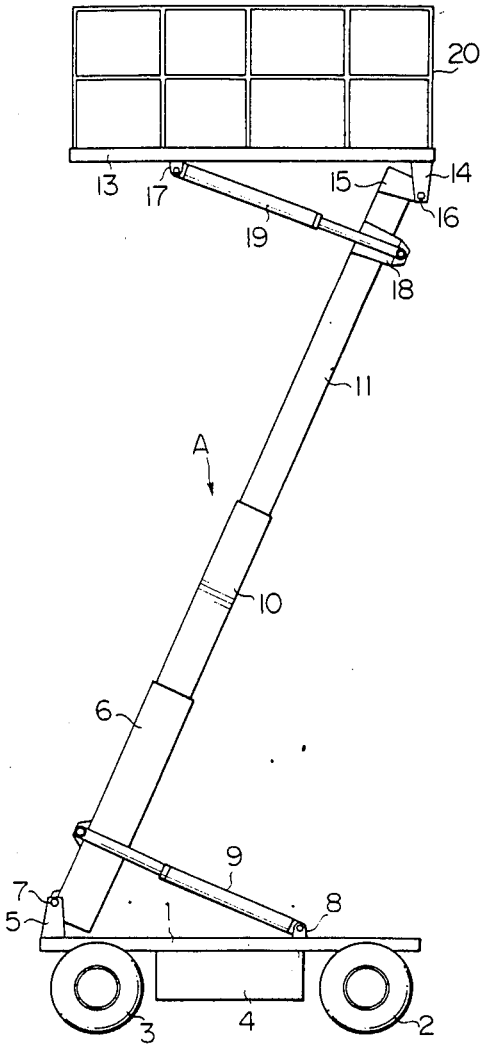
FIG. 4 is a side elevational view of the lifting apparatus with its platform elevated to an upper-most position.

FIGS. 2 and 3 show a lifting apparatus with the platform 13 being lowered to the lowermost position by collapsing the telescopic boom assembly A. At this stage, workers and/or materials are put on the platform which is then raised upwardly. To raise the platform upwardly, the engine in the power box 4 is actuated to produce the oil under pressure which is supplied to the hydraulic cylinders 9 and the hydraulic cylinder 124 inside the lower boom 6. The cylinder rod 125 is extended when the hydraulic cylinder 124 is supplied with oil under pressure so that the middle boom 10 is extended from the lower boom 6 and at the same time the upper boom 11 is extended from the middle boom 10 so that the telescopic boom assembly A is gradually expanded. With the extension of the hydraulic cylinders 9, the lower boom 6 is inclined upwardly about the pin 7 so that the telescopic boom assembly A is raised to an inclined position with respect to the chassis 1. An extension of the hydraulic cylinders 19 allows an angle between the upper boom 11 and the platform 13 to be increased and the extension rates of the hydraulic cylinders 9, 19 are synchronous with each other so that the platform 13 is at all times parallel to the chassis 1 to thereby allow the chassis 1, the telescopic boom assembly A and the platform 13 to be formed in the shape of a Z, when seen in side elevation. The extension rates of the hydraulic cylinders 9, 19, 124 are controlled at a predetermined value, so that the platform 13 is raised upwardly with respect to the chassis 1 and the upper surface thereof is kept horizontal at all times, thereby preventing the workers and/or materials from falling therefrom. Once the platform is raised to the desired height, the hydraulic cylinders are deactuated by the workers thereby allowing the workers to carry out assembling work, repairing work, or painting work, etc.

To lower the platform 13 the oil under pressure in the hydraulic cylinders 9, 19, 124 is released to contract the lengths of the cylinders so that the platform 13 is lowered in a direction which is perpendicular with respect to the chassis 1 with the upper surface thereof being kept horizontal to thereby allow the platform to be returned to the collapsed state.

With the simple structure according to the first embodiment, the platform is raised while being kept horizontally oriented and the single telescopic boom assembly makes it possible to easily maintain and inspect the lifting apparatus with the number of parts used for repair thereof being greatly reduced whereby maintenance costs are also reduced.

FIGS. 6 through 16 (a), (b) and (c) show a second embodiment of the present invention. The lifting apparatus illustrated in FIGS. 8 and 9 includes a telescopic boom B connected between the chassis 1 and the platform 13 substantially in the configuration of a Z, when seen in side elevation.

The telescopic boom assembly B is composed of a hollow lower boom 6, a hollow middle boom 10, and a hollow upper boom 11, each having a rectangular cross section. The lower boom 6 has the largest cross sectional shape and has an upper open end. The middle boom 10 is slightly smaller in cross-sectional size than the lower boom 6 and is slidably inserted in the lower boom 6 through the upper open end thereof. The upper boom 11 is slightly smaller in cross-sectional size than the middle boom 10 and is slidably inserted in the middle boom 10 through its upper open end. The lower boom 6 has a lower end pivotally coupled by the pin 7 to the spaced apart pedestals 5. The hydraulic cylinders 9 have rod ends pivotally coupled to the lower boom 6. A cover member 18' having a channel-shaped cross section which opens downwardly is secured to the upper end of the upper boom 11. The cover member 18' has an upper wall or panel having an inner surface spaced from the boom 11 and in parallel relationship to the outer upper surface of the lower boom 6, there being a clearance defined between the upper boom 11 and the cover member 18' for insertion therein of the lower boom 6. Each of the lower, middle, and upper booms 6, 10, 11 is of a length substantially equal to the length of the chassis 1. The cover member 18' is disposed between the spaced apart pedestals 14 on the platform 13 and is pivotally coupled thereto by means of a pin 16. The hydraulic cylinders 19 have rod ends pivotally coupled to the cover member 18'.

Figure 9:
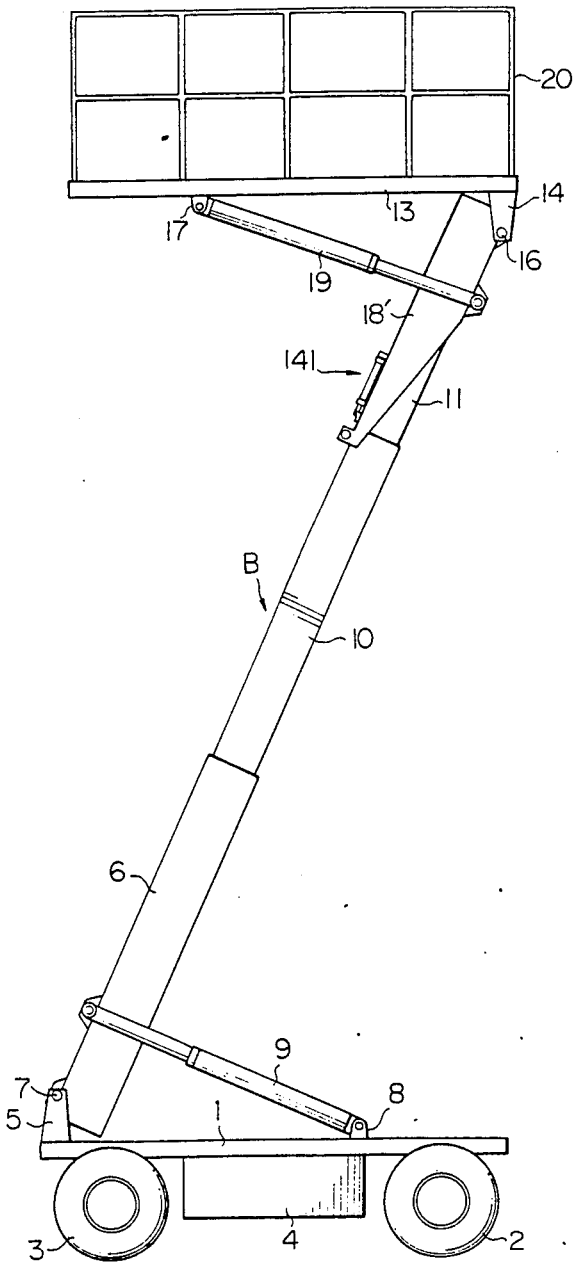
FIG. 9 is a side elevational view of the lifting apparatus with its platform elevated to an upper-most position.
Figure 10:
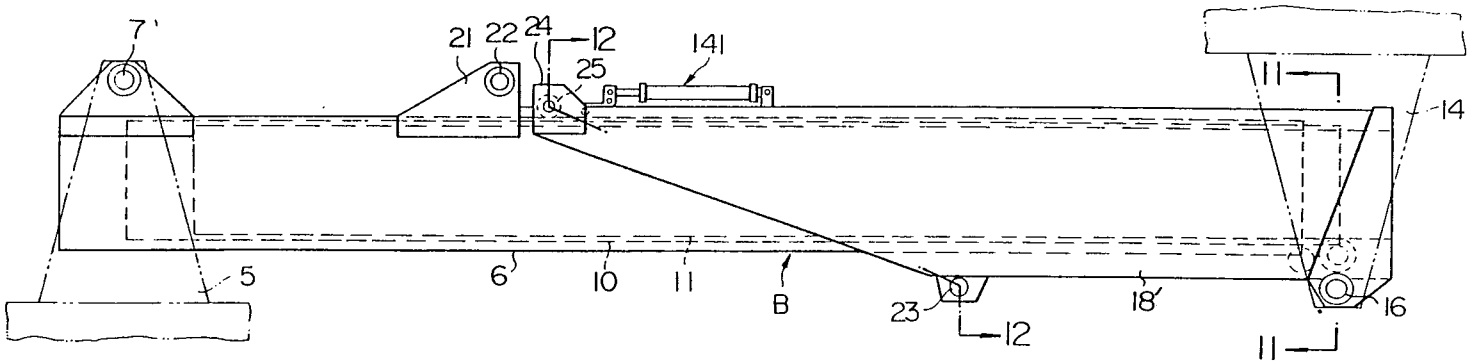
FIG. 10 is a fragmentary side elevational view of a telescopic boom assembly of the lifting apparatus shown in FIG. 9.
Figure 11:
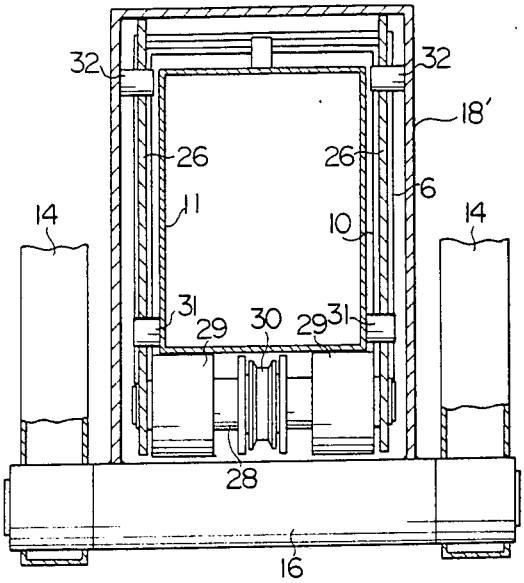
FIG. 11 is an enlarged cross-sectional view taken along line 11—11 of FIG. 10.

FIG. 9 shows a structure of the telescopic boom assembly B composed of the lower boom 6, middle boom 10 and the upper boom 11 which are telescopically fitted together. The cover member 18' includes an upper side having a length of about two thirds the length of the lower boom 6 and the lower edge of each side thereof has a length of about one third the length of the lower boom 6. Pedestals 21 are fixed opposite sides on the upper portion of the lower end of the lower boom 6. at a position spaced about one third from the left or lower end of the lower boom 6 as shown in FIG. 10. The pedestals 21 have holes 22 for connecting the hydraulic cyliners 9 thereto and the cover member 18' also has holes 23 for connecting the hydraulic cylinders 19 thereto. Opposite sides of a pedestal 24 are fixed on the lower end of the cover member 18' at the position shown on the left side of cover 18' in FIG. 10. Rollers 25 are rotatably mounted on the pedestals 24 and are kept in sliding or rolling contact with the upper surface of the lower boom 6. A sliding member 141 as a level difference correction mechanism, hereafter referred to as leveling mechanism is provided on the upper surface of the member 18' at a position close to the pedestals 24. FIG. 11 is a cross-sectional view taken along line 11—11 of FIG. 10, in which auxiliary plates 26 are fixedly mounted on the tip end of the middle boom 10 such that they extend from a bottom side thereof (at right side in FIG. 10) and a support shaft 28 is fixedly mounted between the auxiliary plates at a location spaced from the bottom side of the middle boom 10. Two spaced apart, axially aligned rollers 29 are rotatably mounted on the support shaft 28 between the auxiliary plates 26, the rollers 29 being engageable in rolling contact with the lower surface of the lower panel of the upper boom 11. A pulley 30 is mounted centrally on the support shaft 28 for rotating a chain (not shown) by which the lower and upper booms 6, 11 are interconnected. The auxiliary plates 26 support thereon sliders 31 held in slidable contact with the outer side surfaces of the upper boom 11 and sliders 32 held in slidable contact with the inner side surfaces of the cover member 18'.

Figure 12:
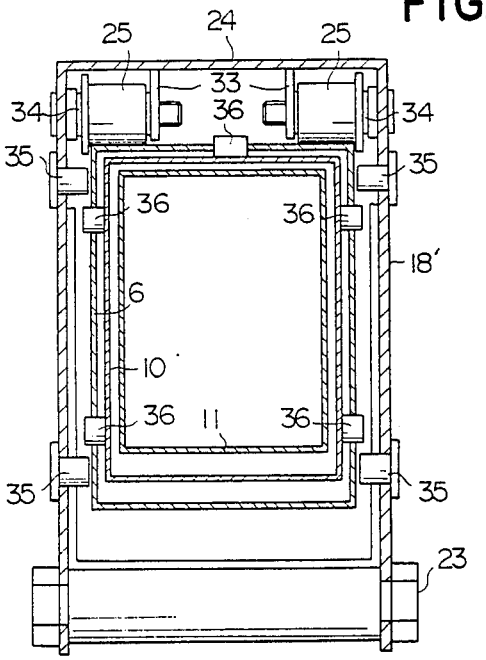
FIG. 12 is an enlarged cross-sectional view taken along line 12—12 of FIG. 10.

FIG. 12 is a cross-sectional view taken along line 12—12 of FIG. 10 in which a support member 33 is fixedly mounted inside each of the opposite sides of the pedestal 24 and extending parallel to the side surface thereof, a pin 34 is provided between each of the opposite sides of the pedestal 24 and the respective support member and one of the rollers 25 is supported on each pin 33. Liners 35 are fixed on the side surface of the cover member 18' such that they are engageable with the side surface of the lower boom 6 and liners 36 are fixed on the lower boom 6 such that they are engageable with the outer surface of the middle boom 10.

Figure 13:
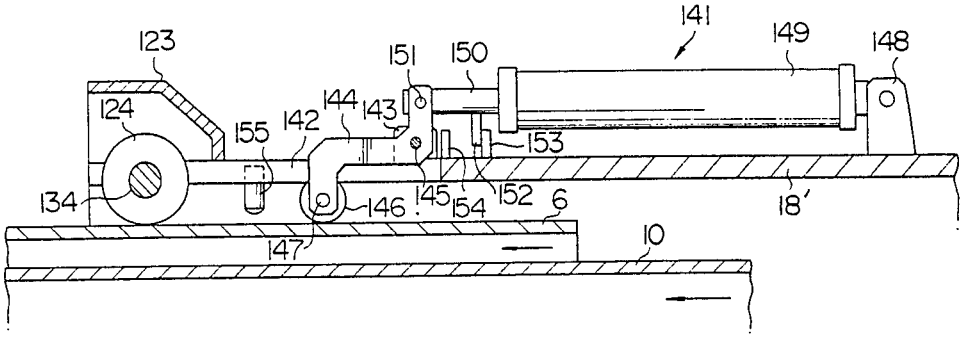
FIG. 13 is an enlarged cross-sectional view showing operation of a slidable mechanism.

The sliding member 141 is shown in detail in FIG. 13, wherein an opening 142 is defined centrally in the cover member 18' at the lower end thereof (at the left side in FIG. 13) pedestals 143 are fixedly mounted on both sides of the opening 142. A lever 144 is pivotally mounted between the pedestals 143 by means of a pin 145. One end of the lever 144 extends outwardly away from a middle section thereof which parallels the upper surface of the cover member 18' and the other end of the lever 144 extends inwardly towards the lower boom 6. A roller 146 is rotatably mounted on the lower end of the lever 144 by means of a pin 147. A clevis 148 is fixed to the upper portion of the cover member 18' at a location spaced from the opening 142. An end of the hydraulic cylinder 149 is connected to the clevis 148 and a tip end of a cylinder rod 150 extending from the cylinder 149 is connected to the upper end of the lever 144 by means of a pin 151. A contact lever 152 is mounted on the piston rod 150 and extends towards the cover member 18' and a pair of limit switches 153, 154 are provided on the surface of the cover member 18' such that they are on either side of and aligned with the contact lever 152. A detector 155 to detect the upper end of the lower boom 6 is provided at a position on the cover member 18' between the rollers 146 and 124 in the vicinity of the opening 142.

Figure 14:
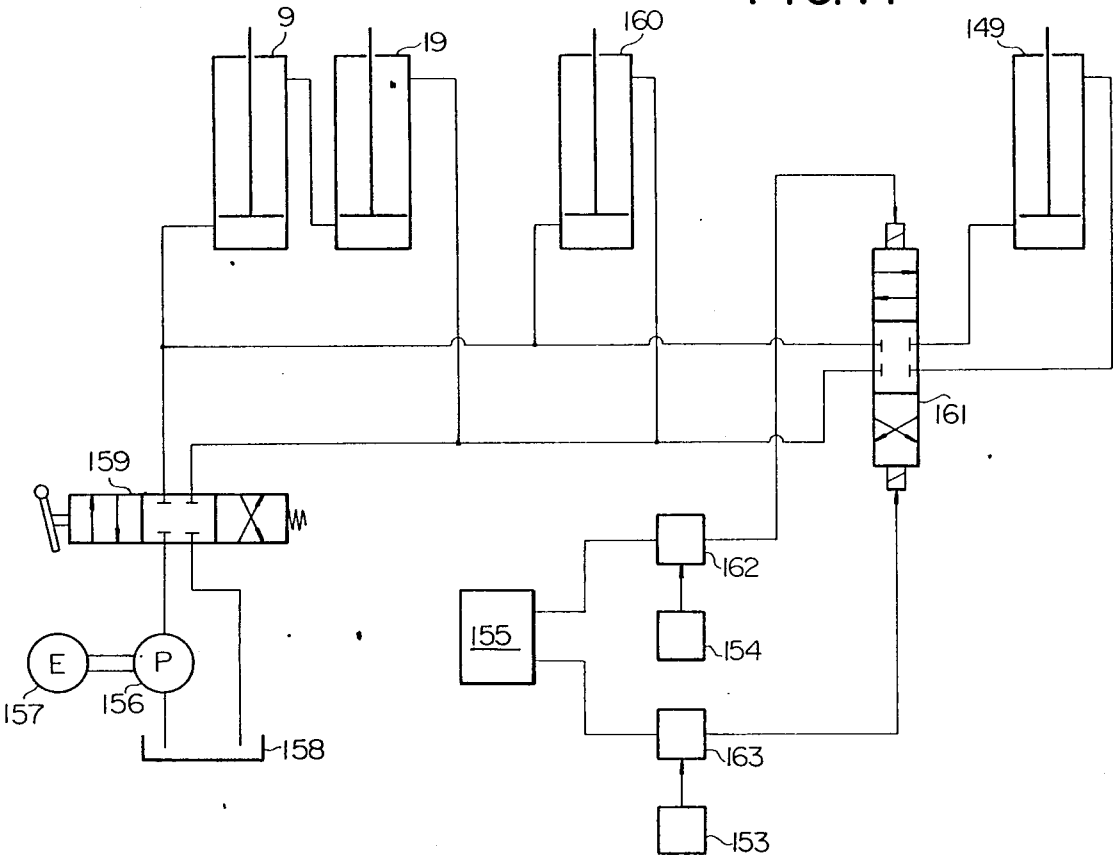
FIG. 14 is a circuit diagram of a hydraulic control system of the lifting apparatus shown in FIG. 6.

A hydraulic circuit according to the present invention is shown in FIG. 14 in which a hydraulic pump 156 is connected to an engine 157. The hydraulic pump has a suction side communicated with an oil tank 158 and a discharge side connected to a directional control valve 159. The control valve 159 is connected to the hydraulic cylinders 9 which have a discharge sides connected to the hydraulic cylinders 19. The hydraulic cylinder 19 each have a discharge side connected to the direction control valve 159 to which a hydraulic cylinder 160 which is mounted inside the boom assembly and a solenoid valve 161 are connected in parallel. The solenoid valve 161 is connected to the hydraulic cylinder 149. The detector 155 detects whether the lower boom 6 is present or not and issues different signals which depend on the state thereof. That is, if no lower boom 6 is detected a signal is produced and applied to one end of the solenoid valve 161 through a switch 162, and if the lower boom 6 is detected a signal is produced and applied to the other end of the solenoid 161 through a switch 163. The limit switches 154 and 153 are provided, respectively, to switches 162 and 163.

Operation according to the second embodiment of the present invention is described hereinafter.

Figure 7:
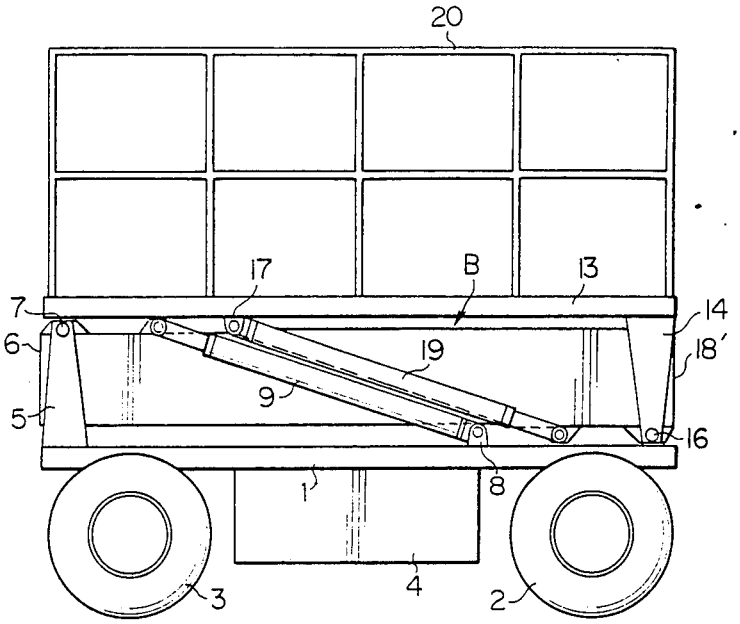
FIG. 7 is a side elevational view of the lifting apparatus of FIG. 6 as it is collapsed.
Figure 8:
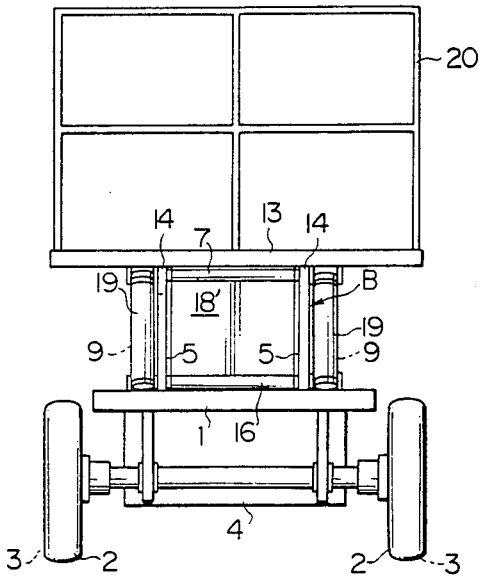
FIG. 8 is a front elevational view of the lifting apparatus shown in FIG. 7.

FIGS. 7 and 8 show the lifting apparatus lowered to the lowest position with the telescopic boom assembly B being contracted. At this stage, workers and/or materials are put on the platform which is then raised upwardly. To raise the platform upwardly, the engine in the power box 4 is actuated to produce the oil under pressure which is supplied to the hydraulic cylinders 9, 19 and the hydraulic cylinder 160 inside the upper boom 11. With the hydraulic cylinder 160 being supplied with oil under pressure, the middle boom 10 is extended from the lower boom 6 and at the same time the upper boom 11 is extended from the middle boom 10 so that the distance between pins 7 and 16 is increased whereby the telescopic boom assembly A is gradually expanded. With the extension of the hydraulic cylinders 9, the lower boom 6 is inclined upwardly about the pin 7 so that the telescopic boom assembly B is raised to an inclined position with respect to the chassis 1. Provided the rate of extension of the hydraulic cylinder 160 accomodated in the upper boom 11 is synchronized with the rate of extension of the telescopic boom assembly, the pin 16 of the cover member 18' is raised upwardly with respect to the chassis 1. Actuation of the hydraulic cylinders 19 causes extension thereof to enlarge the angle between the cover member 18' and the platform 13 with the platform 13 being pivoted about the pin 16. The rate of extension of the hydraulic cylinders 9 is controlled to be synchronous with that of the hydraulic cylinders 19 so that the platform 16 remains parallel to the chassis 1, whereby the chassis 1, the telescopic boom assembly B and the platform 13 are formed in the shape of a Z when seen in side elevation. When the platform is raised to the desired height, the operation of the hydraulic cylinders 9, 19 and 160 is stopped by the workers to thereby keep the lifting apparatus at the same height so that the assembling work, repairing work, painting work, etc. are carried out at that height.

Figure 15:
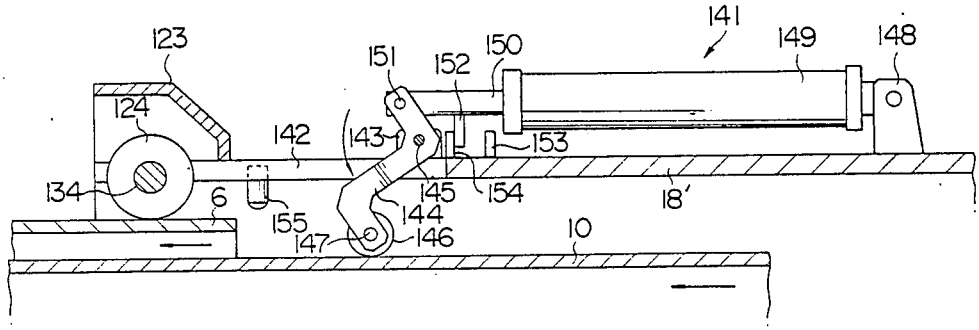
FIG. 15 is an enlarged cross-sectional view showing operation of a slidable mechanism.

The rollers 25 are rotatably brought into contact with the upper surface of the lower boom 6 and are moved with the telescopic boom assembly B as it is expanded and contracted. There are different clearances between the cover member 18' and the upper boom 11, the upper boom 11 and the middle boom 10, and the middle boom 10 and the lower boom 6, which cause the lifting apparatus to be rickety or unstable. Further, the lifting apparatus is likely to be deformed by the load of the platform 13. The load of the platform 13 is delivered to the connection between the hydraulic cylinders 19 and the holes 23 of the cover member 18' which as a result of the stress applied thereto is bent downwardly. However, as mentioned above, since the rollers 25 are rolling over the surface of the lower boom 6, the load is applied to the rollers 25 and delivered to the lower boom 6 so that the cover member 18' is not deformed and instead is extended upwardly along with the upper boom 11 with the platform 16 being kept level and at the same height. In this state, provided that the lower boom 6 is moved along the cover member 18', the upper end of the lower boom 6 is engaged with the lower surface of the roller 146. However, the upper end of the lower boom 6 is detected by the detector 155 to thereby produce a signal which is applied via the switch 162 to the solenoid 161 to actuate the hydraulic cylinder 149 which extends the cylinder rod 150. By the extension of the cylinder rod 150, the lever 144 is rotated counterclockwise to cause the roller 146 to contact with the upper surface of the middle boom 10. The contact lever 152 contacts with the limit switch 154 which deactivates the switch 162 to thereby close the solenoid switch 161. The hydraulic cylinder 149 is kept in the state as shown in FIG. 15. Therefore, if the lower boom 6 is moved further from the cover member 18', the interval between the cover member 18' and the middle boom 10 is kept constant and the platform remains parallel since the load of the platform 13 is delivered to the middle boom 10 via the cover member 18' and the roller 146.

Figure 16A:
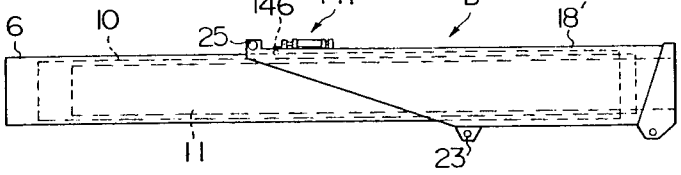
FIGS. 16 (a), (b) and (c) are side elevational views showing operation of the telescopic boom assembly of FIG. 6.
Figure 16B:
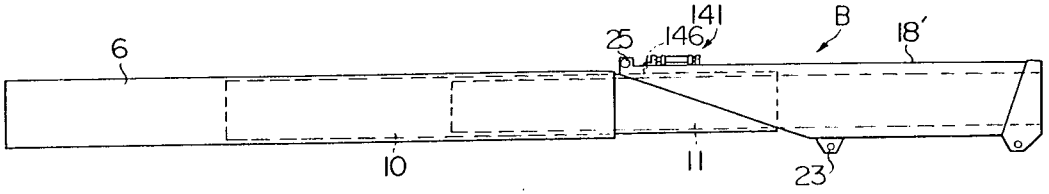
Figure 16C:
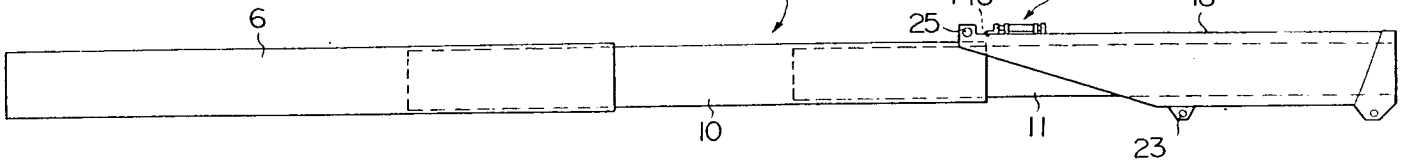
Figure 17:
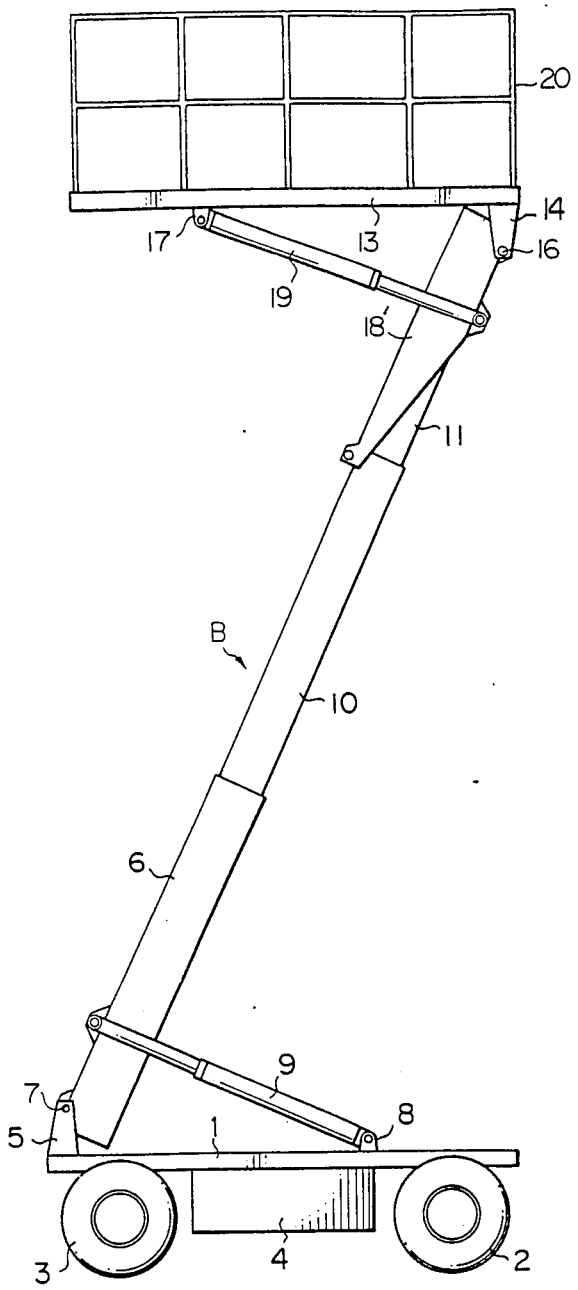
FIG. 17 is a side elevational view of the lifting apparatus according to a third embodiment of the present invention.

FIG. 16 (a) shows a first stage of the extension of the telescopic boom assembly B in which the load from the platform 13 is applied to the holes 23 in the cover member 18' and the load is also applied to the rollers 25. With further extension of the boom assembly, the lower boom 6 is extended away from the cover member 18' thereby allowing the rollers 25 to be moved away from the upper surface of the lower boom 6 (as shown FIG. 16 (b)). The roller 146 contacts with the upper surface of the middle boom 10 and the load applied to the holes 23 is delivered from the cover member 18' through the roller 146 to the middle boom 10 so that the interval between the cover member 18' and upper boom 11 is kept constant. With further extension of the middle boom 10, the interval between the upper boom 11 and the middle boom 10 becomes greater and the roller 146 is rolled over the middle boom 10 until it reaches the tip end thereof, and stops in the state as shown in FIG. 16 (c). This state is the maximum extension of the telescopic boom assembly B. Thus the rolling movement of the rollers 25 is transfered to the roller 146 to cause the telescopic boom assembly B to be moved slidably and smoothly. When the telescopic boom assembly is contracted, the roller 146 is in contact with middle boom 10. With the lower boom 6 being brought into moving contact with the rollers 25, the tip end of lower boom 6 reaches the position of the detector 155 which produces a signal which is delivered to the switch 163 so that the solenoid valve 161 is actuated in the opposite direction. With this operation, the hydraulic cylinder 149 allows the cylinder rod 150 to be contracted which thereby permits the lever 144 to rotate clockwise about the pin 145 so that the roller 146 is moved away from the middle boom 10 as shown in FIG. 13. With further insertion of the lower boom 6 into the cover member 18', the lower boom 6 passes in contact with the lower part of the roller 146.

With the structure according to the second embodiment as mentioned above, the load of the platform having the same area as that of the chassis is applied to the cover member 18', and the load applied to the cover member is successively delivered to the telescopic boom assembly. When the clearances between each of the plural booms comprising the telescopic boom assembly and the cover member are changed during operation thereof, the two rollers are actuated to decrease the clearances so that the load of the platform is safely supported by the telescopic boom assembly.

FIGS. 17 through 22 (a), (b), and (c) show a third embodiment of the lifting apparatus according to the present invention.

The lifting apparatus includes a telescopic boom assembly B connected between the chassis 1 and the platform 6 substantially in the configuration of a Z, when seen in side elevation.

The telescopic boom assembly B is composed of a hollow lower boom 6, a hollow middle boom 10, and a hollow upper boom 11, each having a rectangular cross section. The lower boom 6 has the largest cross-sectional shape and has an upper open end. The middle boom 10 is slightly smaller in cross-sectional size than the lower boom 6 and is slidably inserted in the lower boom 6 through its upper open end. Likewise, the upper boom 11 is slidably inserted in the middle boom 10. The lower boom 6 has a lower end pivotally coupled by a pin 7 to the spaced apart support legs 5. The hydraulic cylinders 9 have rod ends pivotally coupled to the lower boom 6 by means of a pin. A cover member 18' of a channel-shaped cross section opening which is opened downwardly is secured to the upper end of the upper boom 11. The cover member 18' has an upper wall or panel having ann inner surface spaced in parallel relation from the outer surface of the lower boom 6, there being a clearance defined between the upper boom 11 and the cover member 18' for insertion therein of the lower boom 6. Each of the lower, middle, and upper booms 6, 10, 11 is of a length substantially equal to the length of the chassis 1. The cover member 18' is disposed between the spaced support legs 14 on the platform 6 and is coupled thereto by means of a pin 16. The hydraulic cylinders 19 have rod ends pivotally coupled to the cover member 18'.

Figure 18:
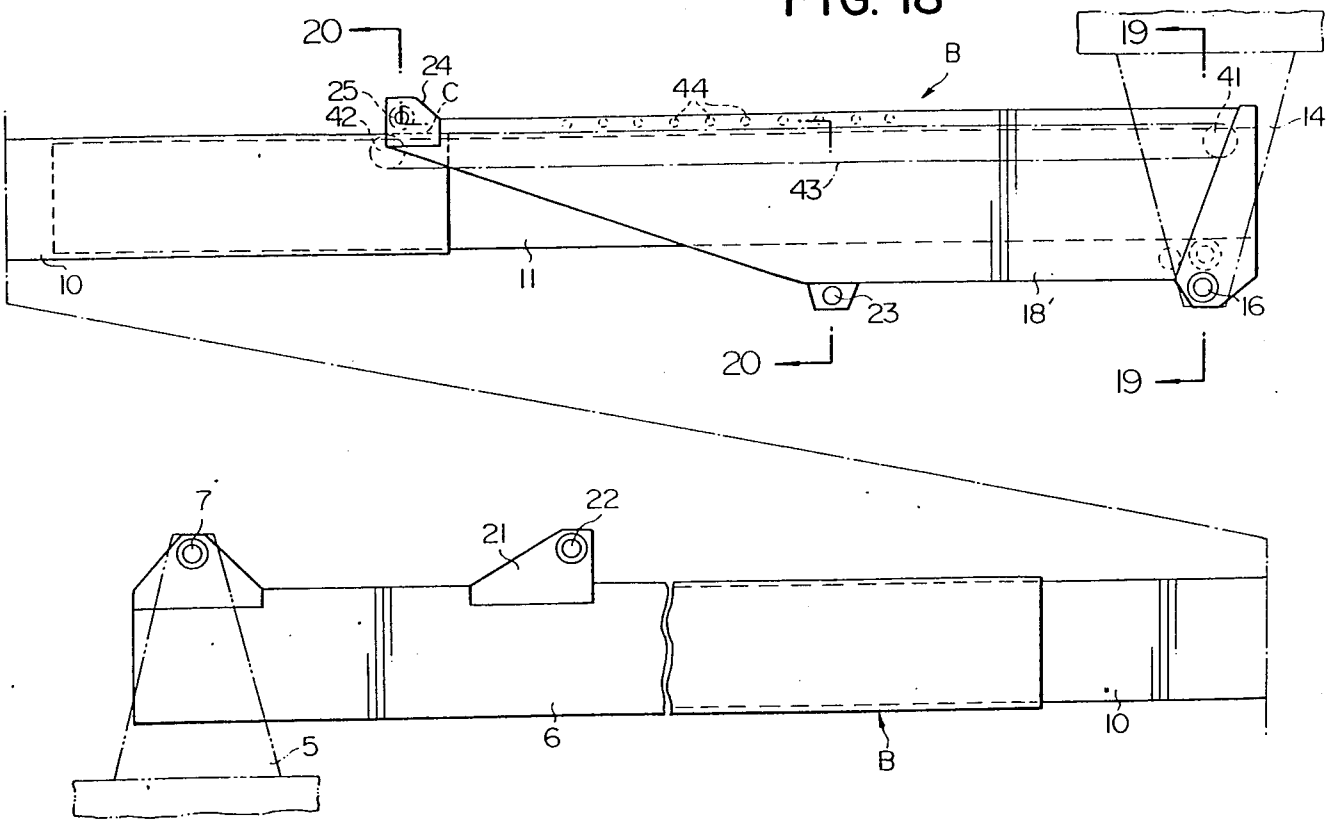
FIG. 18 is a fragmentary side elevatinal view of a telescopic assembly of the lifting apparatus shown in FIG. 17.

As shown in FIG. 18, the cover member 18' has an upper panel of a length which is about $\frac{2}{3}$ of the entire length of the lower boom 6 and opposite depending sides of the cover member 18' each have a lower edge of a length which is about $\frac{1}{3}$ of the entire length of the lower boom 6. The lower boom 6 has pedestals 21 positioned on its upper panel at a distance of about $\frac{1}{3}$ of the entire length of the lower boom 6 from the left or lower end thereof, the pedestals 21 having holes 22 for connection of the cylinders 9 thereto. The cover member 18' has lower pedestals positioned on its lower edges at a distance of about $\frac{1}{2}$ of the upper panel of the entire length of the cover member 18', the lower pedestals having holes 23 for connection of the cylinders 19 thereto. The cover member 18' also has an upper pedestal 24 on its upper panel at the left or lower end which faces the lower boom 6. Rollers 25 are rotatably mounted on the upper pedestal 24 for rolling contact with the upper surface of the lower boom 6.

Sprocket wheels 41 are rotatably supported on the upper boom 11 by shafts 45 which are secured to the upper boom 11, the sprocket wheels 41 being positioned at the upper (right in FIG. 18) end of the upper boom 11. Companion sprocket wheels 42 are also rotatably supported on the upper boom 11 by shafts secured to the upper boom 11, the sprocket wheels 42 being positioned at a distance of about $\frac{1}{3}$ of the entire length of the upper boom 11 from the lower (left in FIG. 18) end of the upper boom 11. Two chains 43 are trained around the sprocket wheels 41, 42, and have ends coupled to the middle boom 10 in the vicinity of its upper end (indicated by C in FIG. 18). A plurality of rollers 44 (preferably ten rollers) made of a slippery material such as MC nylon and serving as spacers are coupled to each of the chains 43 at spaced intervals therealong.

Figure 19:
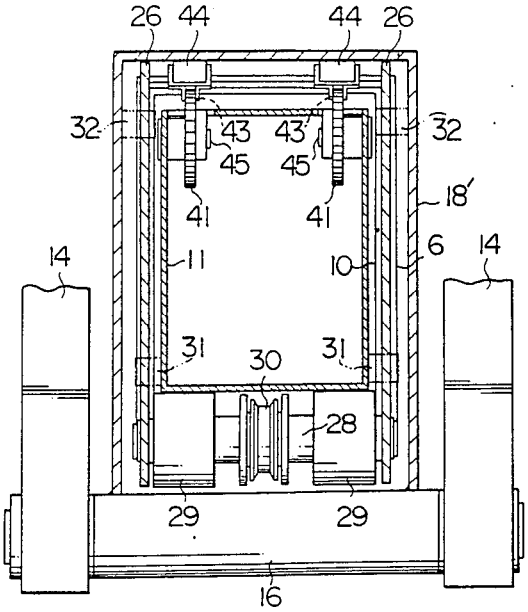
FIG. 19 is an enlarged cross-sectional view taken along line 19—19 of FIG. 18.

As illustrated in FIG. 19, two auxiliary plates 26 are attached to the opposite outer side surfaces of the middle boom 10 on the upper (right in FIG. 18D) end thereof. A support shaft 28 is fixed to and extends between the lower ends of the auxiliary plates 26, and two rollers 29 are rotatably mounted on the support shaft 28 in axially spaced relation between the auxiliary plates 26, the rollers 29 being engageable with the lower surface of the lower panel of the upper boom 11. A pulley 30 is mounted centrally on the support shaft 28 for rotating a chain (not shown) by which the lower and upper boom 6, 11 are interconnected. The auxiliary plates 26 support thereon sliders 31 held in slidable contact with the outer side surfaces of the upper boom 11 and sliders 32 held in slidable contact with the inner side surface of the cover member 18'.

Figure 20:
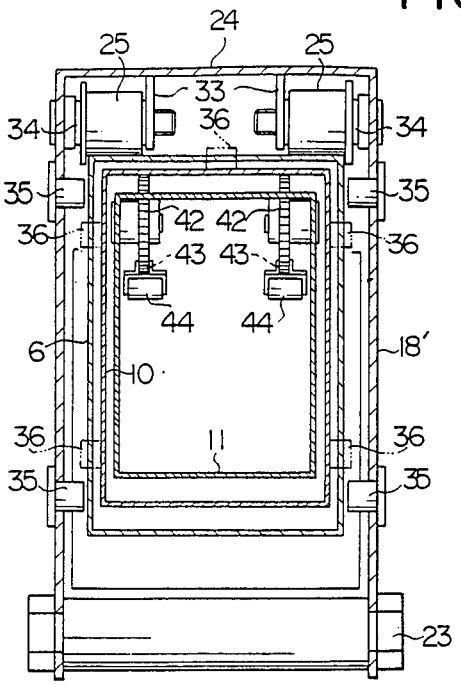
FIG. 20 is an enlarged cross-sectional view taken along line 20—20 of FIG. 10.

As shown in FIG. 20, two parallel support legs 33 are attached in depending relation to the upper pedestal 24. The rollers 25 are rotatably supported on pins coupled between the support legs 33 and the side panels of the pedestal 24. The cover member 18' supports on its side panels liners 35 for abutment against the outer side surfaces of the lower boom 6. The lower boom 6 supports liners 36 for abutment against the outer side surfaces of the middle boom 10.

Figure 21:
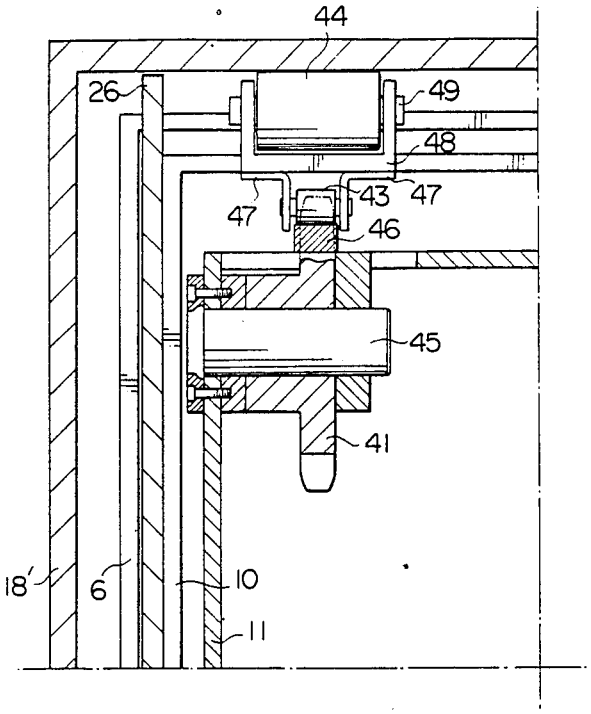
FIG. 21 is an enlarged fragmentary cross-sectional view of the telescopic boom assembly of FIG. 17.

As shown in FIG. 21, a rail 46 made of a material such as MC nylon is fixed to an upper outer surface of the upper boom 11 in parallel relation to the upper boom 11, with the rollers of each of the chains 43 being held in rolling contact with the rail 46. L-shaped angles 47 are attached to both sides of each of the chains 43, and support 48 is attached to and disposed between each pair of L-shaped angles 47. Each of the rollers 44 is rotatably supported on a shaft 49 mounted on the support 48.

Operation of the telescopic boom assembly B shown in FIGS. 18 through 21 will be described as follows.

When the telescopic boom assembly B is extended, the rollers 25 move in rolling contact with the upper surface of the lower boom 13. The load of the platform 6 is imposed through the rod ends of the hydraulic cylinders 19 on the pedestals, so that the cover member 18' is subjected to a downward stress. Since the rollers 25 roll on the upper surface of the lower boom 6, the load on the cover member 18' is also borne by the rollers 25 to guard against undesired deformation of the cover member 18' when the telescopic boom assembly B is being extended to raise the platform 13 while keeping the platform 13 in a horizontal position. As the upper boom 11 and hence the cover member 18' are continuously moved upwardly away from the lower boom 6, the upper end of the lower boom 6 is displaced past the rollers 25. Since the upper end of the middle boom 10 is also slidably moved in a direction away from the upper end of the upper boom 11 when the telescopic boom assembly B is extended, the chains 43 are also moved in a direction out of the upper boom 11 while rotating the sprocket wheels 41, 42. The chains 43 are smoothly moved on the rails 46, along with the rollers 44 attached to the chains 43. The rollers 44 are therefore pulled by the middle boom 10 into the space or clearance between the upper boom 11 and the cover member 18'. At the same time,, the rollers 44 are held in rolling contact with the inner wall surface of the upper panel of the cover member 18'. Therefore, the load on the cover member 18' is transmitted through the rollers 44, the chains 43, and the rails 46 to the upper surface of the upper boom 11. Accordingly, even after the rollers 25 have moved out of contact with the lower boom 6, the load on the cover member 18' is borne also by the upper boom 11, so that the cover member 18' will be prevented from being deformed under the load from the platform 6.

Figure 22A:
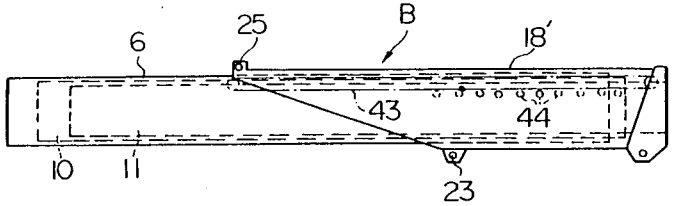
FIGS. 22 (a), (b) and (c) are side elevational views showing operation of the telescopic assembly of FIG. 17.
Figure 22B:
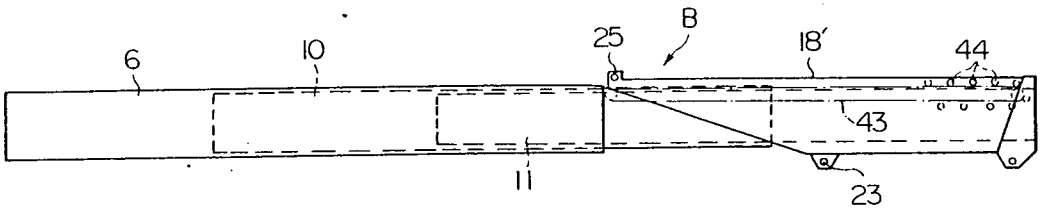
Figure 22C:
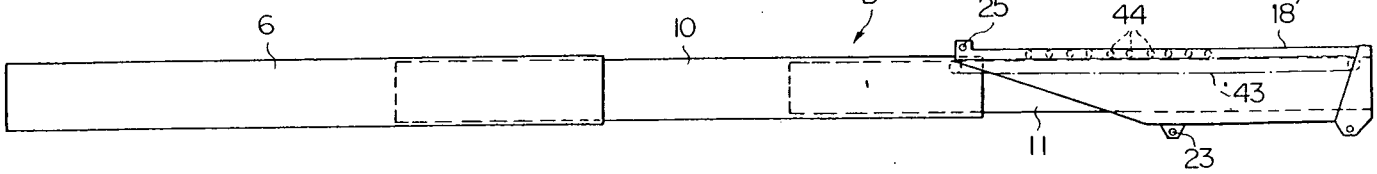
Figure 23:
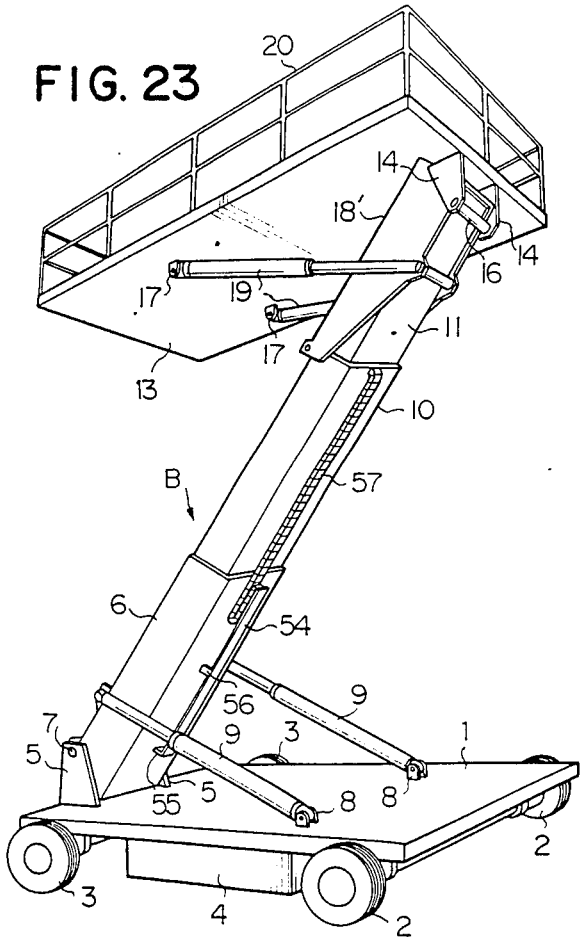
FIG. 23 is a perspective view of a lifting apparatus according to a fourth embodiment of the present invention.
Figure 24:
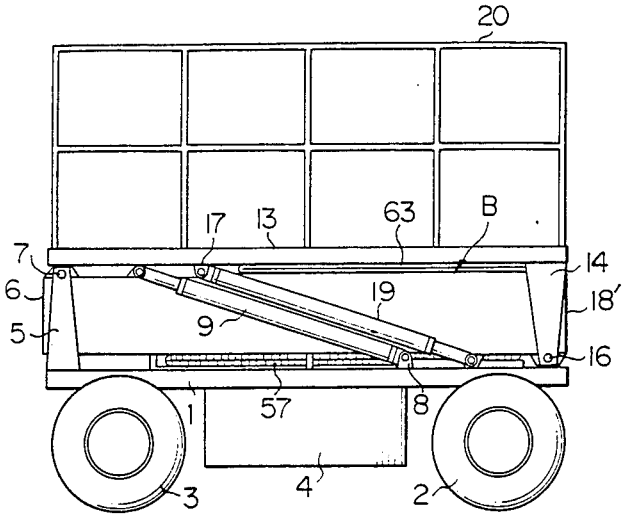
FIG. 24 is a side elevational view of the lifting apparatus of FIG. 23 as it is collapsed.
Figure 25:
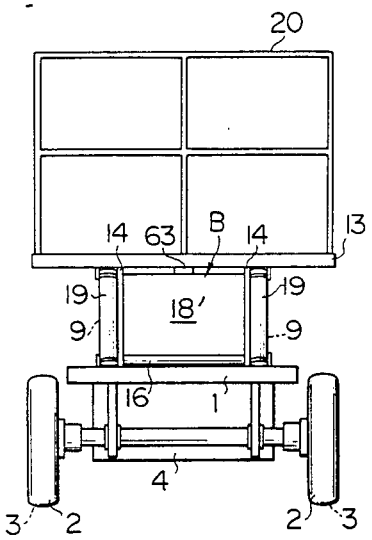
FIG. 25 is a front elevational view of the lifting apparatus shown in FIG. 24.
Figure 26:
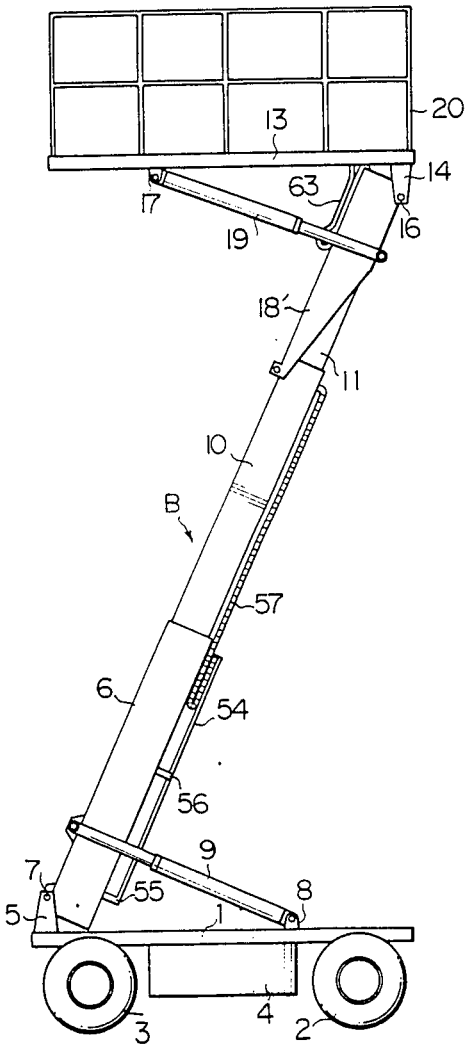
FIG. 26 is a side elevational view of the lifting apparatus with its platform elevated to an upper-most position.

FIG. 22 (a) shows the telescopic boom assembly B which has just started to be extended. The load imposed by the platform 13 on the cover member 18' through the pedestals coupled to the rod ends of the hydraulic cylinders 19 is borne by the rollers 25. When the telescopic boom assembly B is continuously extended until the lower boom 6 is relatively displaced out of the cover member 18', the rollers 25 are brought out of contact with the upper surface of the lower boom 6. At this time, some rollers 44 have already been pulled by the middle boom 10 out of the upper boom 11 into the space between the upper boom 11 and cover member 18'. The load on the cover member 18' is now transmitted through the rollers 44, the chains 43, and the rails to the upper boom 11. The cover member 18' and the upper boom 11 are kept spaced from each other in parallel relation by the rollers 44 which serve as spacers. As the middle boom 10 is further pulled out away from the upper end of the upper boom 11, the rollers 44 are disposed in equally spaced relation between the upper boom 11 and the cover member 18'. The upper boom 11 is drawn progressively out of the middle boom 10 until the telescopic boom assembly B is fully extended. The telescopic boom assembly B is therefore smoothly extended while the cover member 18' is supported securely by the rollers 25 and then the rollers 44. When the telescopic boom assembly B is contracted, the upper boom 11 is progressively inserted into the middle boom 10 which is in turn progressively pushed into the lower boom 6. The chains 43 are moved in the reverse direction to move the rollers 44 back into the upper boom 11. When the lower end of the cover member 18' approaches the upper end of the lower boom 6, the rollers 25 begin to roll on the upper surface of the lower boom 6. The telescopic boom assembly B is thus contracted from the position of FIG. 22 (c) to that shown in FIG. 22 (a). The load on the cover member 18' is therefore transmitted first to the rollers 44 and then to the rollers 25.

While the spacers between the cover member 18' and the upper boom 11 are shown as comprising the cylindrical rollers 44, the spacers may be rectangular or triangular in shape provided they fill the space between the cover member 18' and the upper boom 11.

With the arrangement shown in FIGS. 17 through 22, the load applied to the cover member 18' by the platform 13 can be transmitted to the telescopic boom assembly B first through the rollers 25 and then through the rollers or spacers 44 or vice versa while the telescopic boom assembly B is being extended or contracted. Therefore, the load from the platform 13 can reliably be borne by the telescopic boom assembly B without deforming the cover member 18' even if the telescopic boom assembly B is extended to an increased length with the lower and middle booms 6, 10 being successively pulled out of the cover member 18'.

Figure 27:
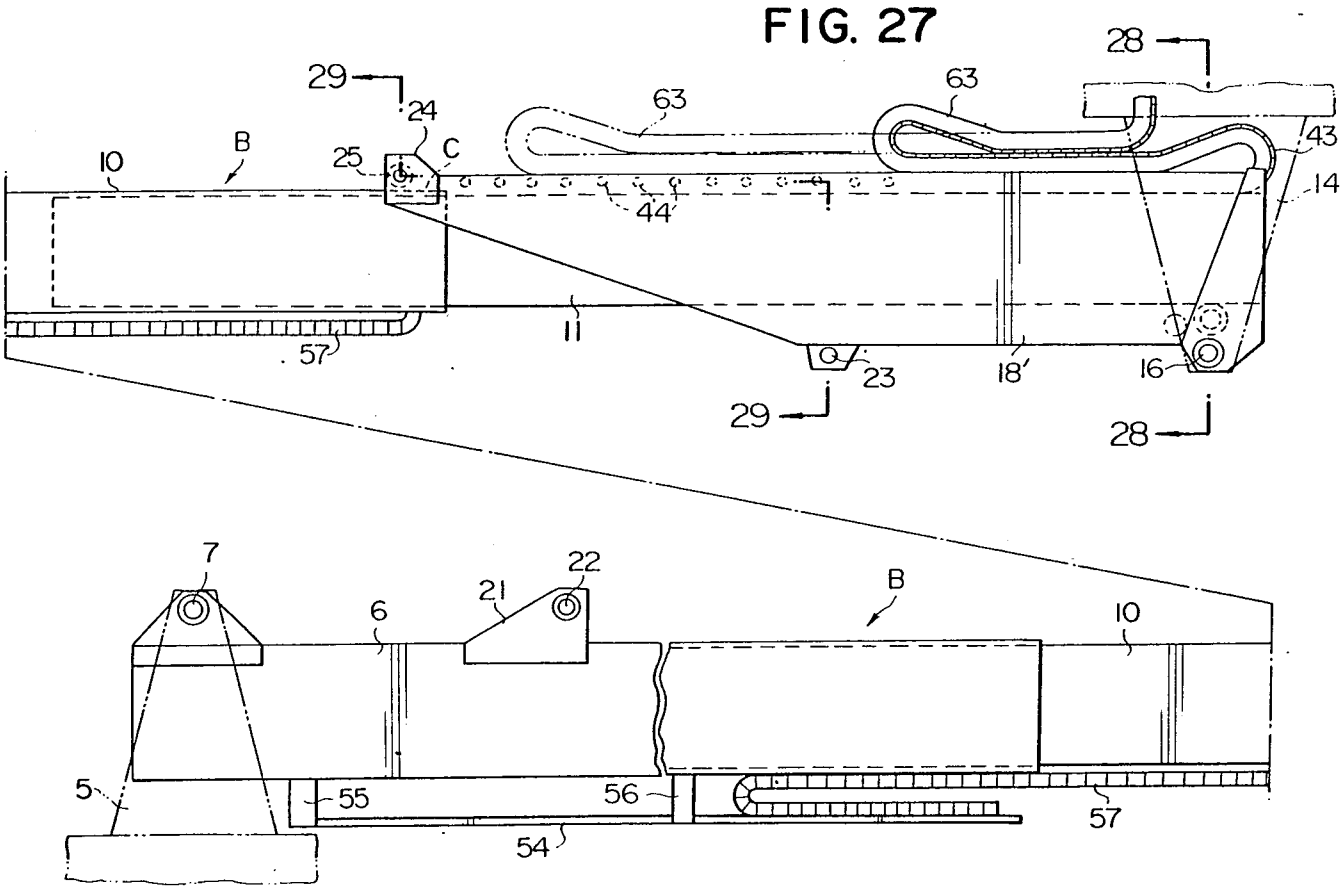
FIG. 27 is a fragmentary side elevational view of a telescopic boom assembly of the lifting apparatus shown in FIG. 23.
Figure 28:
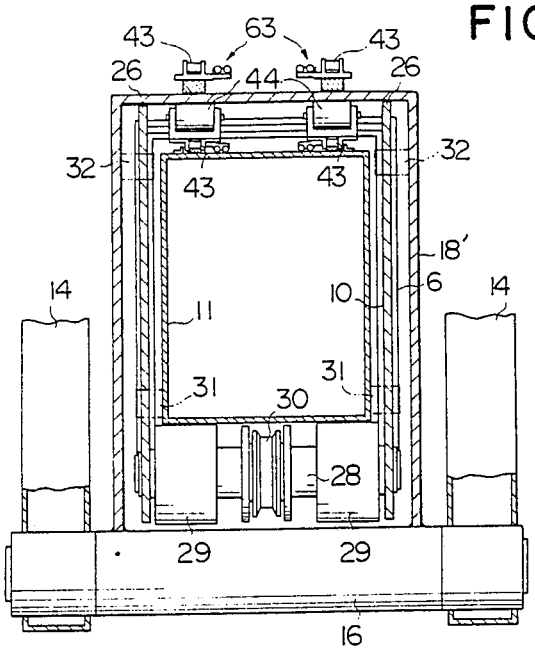
FIG. 28 is an enlarged cross-sectional view taken along line 28—28 of FIG. 10.
Figure 29:
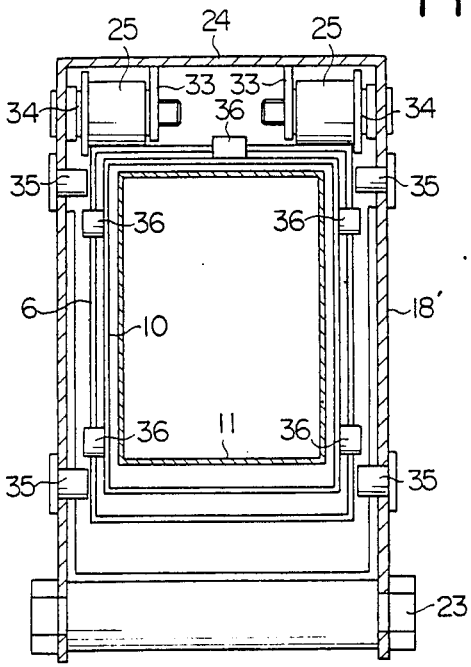
FIG. 29 is an enlarged cross-sectional view taken along line 29—29 of FIG. 10.

FIGS. 23 through 31 (a), (b) and (c) show a telescopic boom assembly B according to fourth embodiment of the present invention. The telescopic boom assembly B is similar to the telescopic boom assembly B shown in FIGS. 17 through 22, but differs therefrom in that a pair of chains 43 is disposed between the upper outer surface of the upper boom 11 and the lower inner surface of the cover member 18', each of the chains 43 having one end coupled to the upper end C of the middle boom 10, as shown in FIG. 27. The chains 43 extend out of the upper end of the cover member 18' and are placed as two superimposed folds on the upper outer surface of the cover member 18'. The opposite ends of the chains 43 are coupled to the lower surface of the platform 13. A plurality of rollers 44 made of a slippery material such as MC nylon and serving as spacers are coupled at spaced intervals to one side of each of the chains 43 for rolling contact with the upper inner surface of the cover member 18'. Cable assemblies 63 each composed of a plurality of bunched hydraulic rubber hoses extend along and are attached to the chains 43, respectively, for movement therewith. The cable assemblies 63 are coupled at lower ends thereof to other cable assemblies 57 in the middle boom 10, and at upper ends thereof to a control panel (not shown) on the platform 13.

Figure 30:
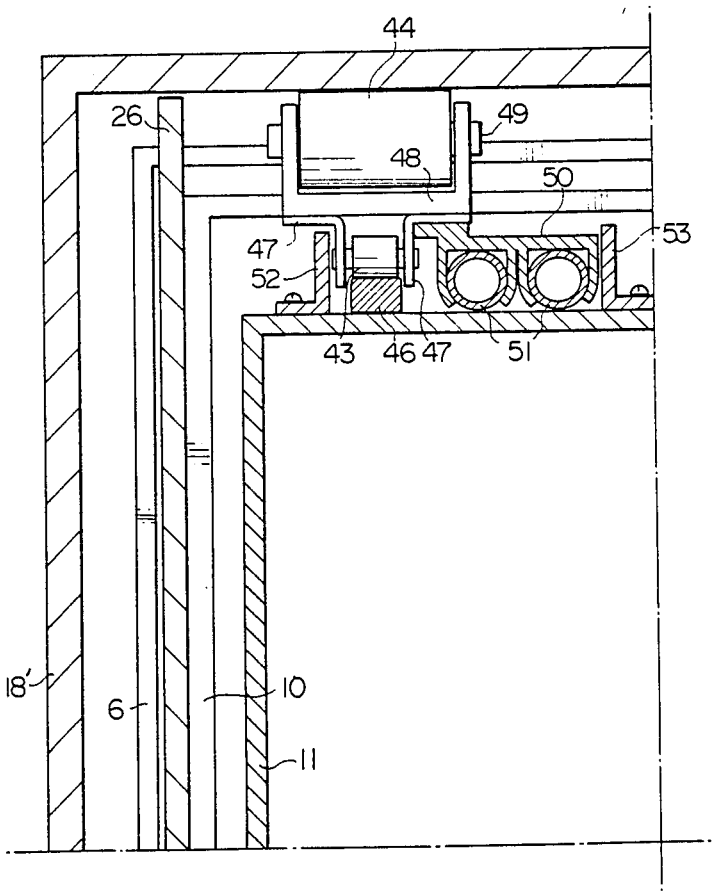
FIG. 30 is an enlarged fragmentary cross-sectional view of the telescopic boom assembly of FIG. 23.

As illustrated in FIG. 30, the rollers 44 are each coupled to the chain 43 by the angles 47, the support 48, and the shaft 49, and the chain 43 is movable on and along the rail 46 between L-shaped guide members 52 and 53 mounted on the upper boom 11 in the same manner as shown in FIG. 21. Each of the cable assemblies 63 has a pair of hydraulic hoses 51 supported by a substantially horizontal hose holder 50 joined to one of the angles 47. The chain 43, rollers 44 and cable assemblies 63 are placed loosely on the surface of the cover member 18'. The load applied to the hole 22 where the rod ends of hydraulic cylinders 19 are coupled to the cover member 18' is supported by the rollers 25. The lower cable assemblies 57 are folded over and placed in the cable receiver 54 which is spaced from the lower panel of the lower boom 6 by spacers 55 and 56.

Figure 31A:
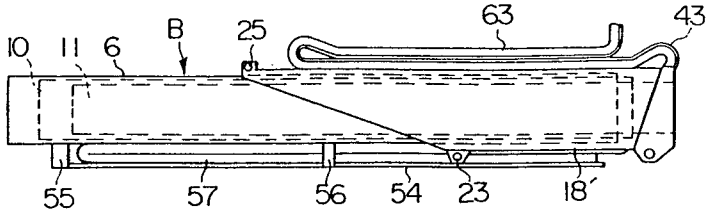
FIGS. 31 (a), (b) and (c) are side elevational views showing operation of the telescopic boom assembly of FIG. 23.
Figure 31B:
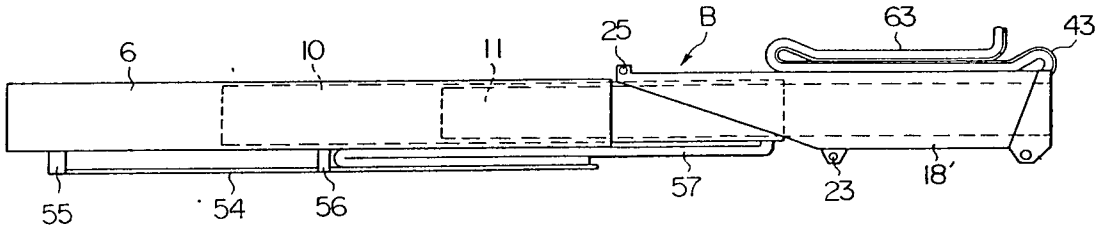
Figure 31C:
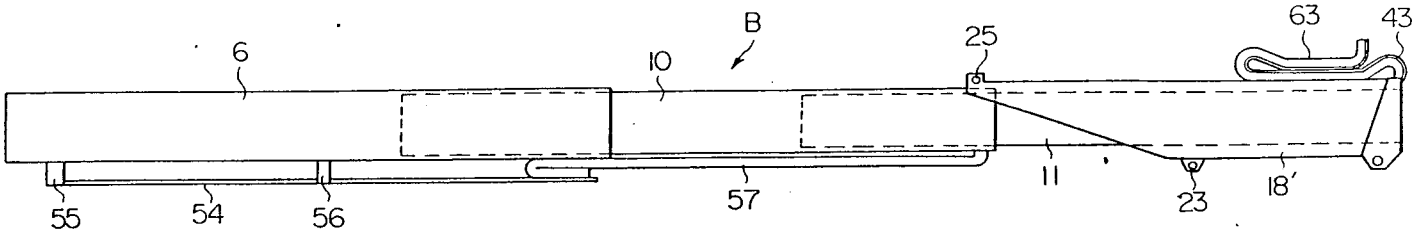

Operation of the telescopic boom assembly B is substantially the same as the operation of the telescopic boom assembly B shown in FIGS. 17 through 22. When the telescopic boom assembly B begins its extension as shown in FIG. 31 (a), the chains 43, the rollers 44, and the cable assemblies 63 are in a folded condition on the upper surface of the cover member 18' and the load imposed on the cover member 18' from the platform 13 is borne by the rollers 25 held against the lower boom 6. As the telescopic boom assembly B is further extended, the lower boom 6 is drawn out of the cover member 18' to displace the rollers 25 out of contact with the upper surface of the lower boom 6 as shown in FIG. 31 (b). At this time, the chains 43 and hence the rollers 44 thereon are partly drawn into the space between the upper boom 11 and the cover member 18'. The load on the cover member 18' is now transmitted through the rollers 44 to the upper boom 11, while the cover member 18' and the upper boom 11 are kept parallel to each other. The lower cable assemblies 55 are pulled out upwardly at the same time with the middle boom being pulled out and the loosened cables are successively pulled out from the cable receiver 54. Upon continued extension of the telescopic boom assembly B, the middle boom 10 is drawn out of the cover member 18' away from the upper end thereof, during which time the rollers 44 move in rolling contact and at equal intervals between the upper boom 11 and the cover member 18'. The upper boom 11 is relatively pulled progressively in the direction out of the middle boom 10 until the telescopic boom assembly B is fully extended as shown in FIG. 31 (c). Therefore, the load on the cover member 18' is first borne by the rollers 25 and then by the rollers 44, preventing the cover member 18' from being displaced or deformed. While the telescopic boom assembly B is being thus extended, the cable assemblies 63 are also drawn with the chains 43 into the cover member 18'. When the telescopic boom assembly B is contracted, the chains 43 and the cable assemblies 63 are progressively pushed out of the cover member 18' and placed in the folded configuration onto the upper surface of the cover member 18'. The load on the cover member 18' is first borne by the rollers 44 and then by the rollers 25, preventing the cover member 18' from being displaced or deformed during contraction of the telescopic boom assembly B.

With the fourth embodiment of this invention, the weight of the platform and the load on the platform are imposed on the cover member, next to the telescopic boom assembly via rollers and the spacers successively. Even if there occurs a difference in clearances between each of the booms when they are extended, the leveling mechanism is actuated to compensate for the difference in clearance between the upper surfaces of the lower and middle booms and the inner surface of the cover member so that the stretchable boom can ensure maximum support of the platform.

What is claimed is:

1. A lifting apparatus comprising:

(a) a chassis;

(b) a platform;

(c) a telescopic boom assembly connecting said chassis and said platform together, said telescopic boom assembly being composed of a plurality of telescopically movable booms which are axially aligned with each other;

(d) a cover member mounted on an upper one of said booms closest to said platform and having an end extending towards one of said booms other than said upper boom closest to said platform, said cover member overlying said upper boom closest to said platform and said booms other than said upper boom, said cover member being engageable with an upper surface of each of said booms other than said upper boom when said telescopic boom assembly is expanded and contracted;

(e) at least one first hydraulic cylinder disposed in said telescopic boom assembly for extending and contracting said telescopic boom assembly;

(f) at least one second hydraulic cylinder operatively coupled between said telescopic boom assembly and said chassis for tilting said telescopic boom assembly with respect to said chassis;

(g) at least one third hydraulic cylinder operatively coupled between said cover member and said platform for keeping said platform substantially parallel to said chassis; and (h) a hydraulic control system for operating said first, second and third hydraulic cylinders in synchronism to move said platform toward and away from said chassis in a direction which is substantially perpendicular to said chassis.

2. A lifting apparatus according to claim 1, wherein said plurality of booms comprises a lower boom pivotally coupled to said chassis, said upper boom and a middle boom with which said lower and upper booms are telescopically fitted together, said first hydraulic cylinder being connected to said lower and upper booms, said second hydraulic cylinder being operatively coupled between said lower boom and said chassis.

3. A lifting apparatus according to claim 1, wherein said cover member includes a leveling mechanism for compensating for the difference in clearances between each surface of said booms and said cover member to ensure a vertical and horizontal movement of said platform.

4. A lifting apparatus according to claim 3, wherein said leveling mechanism is a sliding member.

5. A lifting apparatus according to claim 4, wherein said sliding member comprises a fourth hydraulic cylinder mounted on said cover member, a rod slidably inserted in said fourth hydraulic cylinder and having a contact lever thereon, limit switches provided on said cover member for contacting said contact lever when said rod is extended and retracted into said cylinder, a lever having one end pivotally connected to said rod, said lever also being pivotally mounted on said cover member, and a roller rotatably mounted on the other end of said lever.

6. A lifting apparatus according to claim 5, wherein said roller is movable on the surface of said lower and middle booms, and said roller disposed between ends of an opening provided on said cover member, movement of said roller being controlled by a detector disposed on said cover member and positioned in said opening, said detector operatively connected to said hydraulic control system and producing a signal when adjacent an end of said lower boom facing said cover member for allowing said lever to be pivoted whereby said roller is moved in rolling contact from the surface of said lower boom to the surface of said middle boom.

7. A lifting apparatus according to claim 1, wherein said plurality of booms include said upper boom, a middle boom slidably inserted in said cover member and slidably movable in and out of said cover member, and a lower boom.

8. A lifting apparatus according to claim 6, including at least one roller mounted on said middle boom and slidably inserted between said cover member and said upper boom and movable along with said middle boom in and along said cover member for supporting said upper boom.

9. A lifting apparatus according to claim 6, wherein said hydraulic control system comprises said detector, said limit switches, and a solenoid valve, said detector detecting the position of the tip end of said lower boom when said telescopic boom assembly is extended and producing a signal which is applied to one of said limit switches to actuate said solenoid valve so that said rod of said fourth hydraulic cylinder is extended to move said roller in contact with said middle boom and thereby keep said platform parallel to said chassis, said detector detecting the position of the tip end of the lower boom when said telescopic boom assembly is contracted and producing another signal which is applied to the other one of said limit switches to actuate said solenoid valve so that said rod of said fourth hydraulic cylinder is retracted to bring said roller into contact with the upper surface of said lower boom.

10. A lifting apparatus according to claim 1, wherein said cover member is maintained parallel to the upper surface of said upper boom by means of at least one roller mounted on a chain extending between said upper boom and another one of said booms, said at least one roller being disposed inside said upper boom when said telescopic boom assembly is contracted and said at least one roller being movable between said cover member and said upper boom when said telescopic boom assembly is expanded.

11. A lifting apparatus according to claim 10, wherein a plurality of rollers are disposed on said chain.

* * * * *